United States Patent [19]

Stephano

[11] Patent Number: 4,608,623

[45] Date of Patent: Aug. 26, 1986

[54] AUTOMOBILE HEADLAMP WITH INCLINED FRONT GLASS

[75] Inventor: Marc Stephano, Livry Gargan, France

[73] Assignee: Cibie Projecteurs, Bobigny, France

[21] Appl. No.: 585,822

[22] Filed: Mar. 2, 1984

[30] Foreign Application Priority Data

Mar. 8, 1983 [FR] France ..... 83 03764

[51] Int. Cl.[4] ..... F21M 3/18; F21V 5/02

[52] U.S. Cl. ..... 362/80; 362/309

[58] Field of Search ..... 362/61, 80, 82, 290, 362/292, 293, 307, 308, 309, 310, 311, 328, 339

[56] References Cited

U.S. PATENT DOCUMENTS

| | | | |
|---|---|---|---|
| 2,568,494 | 9/1951 | Geissbuhler | 362/309 |
| 4,238,817 | 12/1980 | Fratty | 362/309 |
| 4,272,801 | 6/1981 | Fratty | 362/61 X |
| 4,369,488 | 1/1983 | Brun | 362/309 X |
| 4,446,511 | 5/1984 | Sands | 362/80 X |
| 4,456,948 | 6/1984 | Brun | 362/308 X |

FOREIGN PATENT DOCUMENTS

| | | | |
|---|---|---|---|
| 1024923 | 4/1953 | France . | |
| 2405425 | 5/1979 | France . | |
| 2084309 | 4/1982 | United Kingdom | 362/309 |

*Primary Examiner*—W. R. Wolfe

*Attorney, Agent, or Firm*—McCormick, Paulding & Huber

[57] ABSTRACT

A headlamp for an automobile comprising a light source ($F_C$) a reflector (F) co-operating with this light source in order to reflect in a direction of emission a beam of substantially parallel rays, and a front glass (G) for dispersion and diffusion interposed in the path of the light rays, this glass being inclined with respect to the direction of emission. The glass has on its internal face, correcting optical elements (10) the active surface (11) of each of which is defined by the intersection of a prism inclined by an angle $\alpha$ with respect to the vertical plane passing through the direction of emission and having an angle $\beta$ at the apex, and a cylindrical rib having an axis parallel to the prism and a radius r, in such a way that the inclination $\alpha$ of the prism compensates for the effect of vertical deflection caused by the inclination of the glass.

11 Claims, 16 Drawing Figures

AUTOMOBILE HEADLAMP WITH INCLINED FRONT GLASS

The present invention relates to automobile headlamps having an inclined front glass.

It is known that in the modern automobile designs the majority of headlamps are incorporated into the body of the verhicle. A headlamp conventionally comprises at least one light source, at least one reflector which is most frequently parabolic and reflects the rays from the source towards the front in a beam made up of rays substantially parallel to a direction of emission, and a glass for diffusion and dispersion situated in front of the reflector and the source. The incorporation of a headlamp in the body of a vehicle means that the glass has to follow the shape and line of the body of the vehicle whether or not it is connected to it. For vehicles in which the body has a stream-lined aerodynamic shape at the location of the headlamps, the integration of the headlamp means that the glass is more or less inclined. Thus, in operation, it is not vertical but inclined with respect to the vertical, this inclination being principally directed from the bottom towards the top and from the front towards the rear, which means that the lower zones of the glass are set further forwards along the axis of the vehicle and the upper zones are set further back. One might also wish for glasses inclined in the opposite direction (complementary headlamps placed under the bumper for example). The same characteristics are observed in the inverse direction.

From the optical point of view, the glasses generally have reliefs for diffusion and dispersion (vertical ribs of different sections) so that the beam reflected by the reflector is spread well, and these reliefs deflect the light rays laterally by refraction. Until now the inclined glasses have been treated as traditional vertical glasses by providing them with analogous reliefs for diffusion and dispersion. However, whilst this solution may be acceptable for slight inclinations (for example up to about 20° from the vertical) it becomes rapidly unacceptable for more greatly inclined glasses. In fact, inclining the glass involves deflecting the light rays downwards and this is all the more marked as the horizontal lateral deviation of these same rays, as reflected by the reflector, is significant. In the case of a glass inclined at 45°, for example, one might consider the deflection downwards as negligible when this horizontal deflection does not exceed 6°. However, with a horizontal deflection above 6° the deflection of the rays becomes significant and necessitates correction. This phenomenon is especially marked for cut-off beams such as dipped beams, particularly for the light rays which are situated immediately below the cut-off zone of the beam.

FIGS. 1, 1*a*, 2 and 2*a* illustrates the drawbacks caused by the inclination of the glass.

FIG. 1 shows a traditional headlamp provided with a parabolic reflector R having a focus F, a glass G and light sources or filaments for main beam $F_R$ and dipped beam $F_C$. The glass G in FIG. 1 is vertical. The illumination pattern shown in FIG. 1*a* is the traditional representation of a spot of light on a screen at 25 meters from such a structure. The central zone of the glass G of FIG. 1 is provided with ribs for lateral spreading and as can be seen in FIG. 1*a* produces a horizontally spread band of light.

FIGS. 2 and 2*a* are similar to FIGS. 1 and 1*a*, the only different being that the glass G is now inclined but retains the same reliefs for dispersion and diffusion as before. This time (FIG. 2*a*) a curved band of light corresponds to the same central zone of the glass. Overall, the beam is reduced in width. Such a modification of the appearance of the beam is generally unacceptable. This applies particularly to dipped headlamps, for the band of light immediately below the cut-off, since all the light thus lowered is too close to the vehicle and partially situated outside the field of vision of the driver and this results in significant reduction in driving comfort.

Thus it will be seen that it is no longer advisable to retain the traditional construction of straight (vertical) glasses for glasses with steep inclinations, for example of the order of 45°.

It is an object of the present invention to provide a structure for an inclined glass which remedies the drawbacks referred to above.

More specifically it is an object of the invention to compensate for the effect of the inclination of the glass which tends to deflect the light rays downwards, all the more as these rays have a greater lateral angular deflection after having passed through the glass.

A simple solution which might immediately present itself would consist of associating with every prism which laterally diffuses the light rays in a horizontal direction a second prism correcting the deflection of the rays in a vertical direction caused by the inclination of the glass. Such a solution would not be entirely satisfactory because it would result in the necessity for extra thicknesses of the glass caused by the addition of the correcting prisms and would also result in a beam formed of spots.

According to the present invention there is provided a headlamp for an automobile comprising at least one light source, at least one reflector co-operating with the light source in order to reflect a beam of substantially parallel rays, an inclined front glass located in the path of the light rays, the glass being formed, in certain critical zones, with optical elements arranged to disperse and/or diffuse the rays, the optical elements each having an active surface defined by the intersection of a prism inclined by an angle $\alpha$ with respect to the vertical plane passing through the direction of light emission, the prism having an angle $\beta$ at its apex, and a part-cylindrical rib whose axis is parallel to the inclination $\alpha$ of the prism, whereby the inclination of the prism compensates for the vertical deflection effect caused by the inclination of the glass.

Preferably the correcting optical elements are on the inside surface of the glass.

The critical zones of the glass with which the inclined prism ribs are associated are preferably those which are there in order to give the light rays the greatest horizontal lateral deflection, corresponding to the greatest deflection which needs to be "restored". In particular, in the case of a dipped headlamp, these are the zones of the glass corresponding to the parts of the beam situated just below the cut-off.

The limits of each prism rib on the glass can extend parallel to the direction of the prism with respect to the vertical. The glass may then appear, in the critical zones, as a succession of more or less inclined bands. Alternatively, these could be distributed in vertical parallel bands, whilst retaining the active surfaces defined above, which may minimise the problem of connection between zones and thus facilitates production of the glass by moulding.

Another critical zone of the glass to which the invention may be advantageously applied is the zone which, for a dipped beam, extends to the centre of the glass in its upper part. For this zone, single prism ribs can be provided which are inclined in one or the other direction depending upon whether they are to the left or the right of the glass. In addition, double prism ribs can also be used, each consisting of a combination of two active surfaces arranged in pairs.

The following description with reference to the accompanying drawings takes as an example the application of the invention to a dipped beam with an inclined glass. However, it should be understood that it applies generally to any headlamp in which, for certain zones of the inclined glass, it is necessary to correct an inopportune deflection of the rays caused by the inclination of the glass.

The invention may be carried into practice in various ways and some embodiments will now be described by way of example with reference to FIGS. 3 to 13 of the accompanying drawings, in which.

Figure 4:
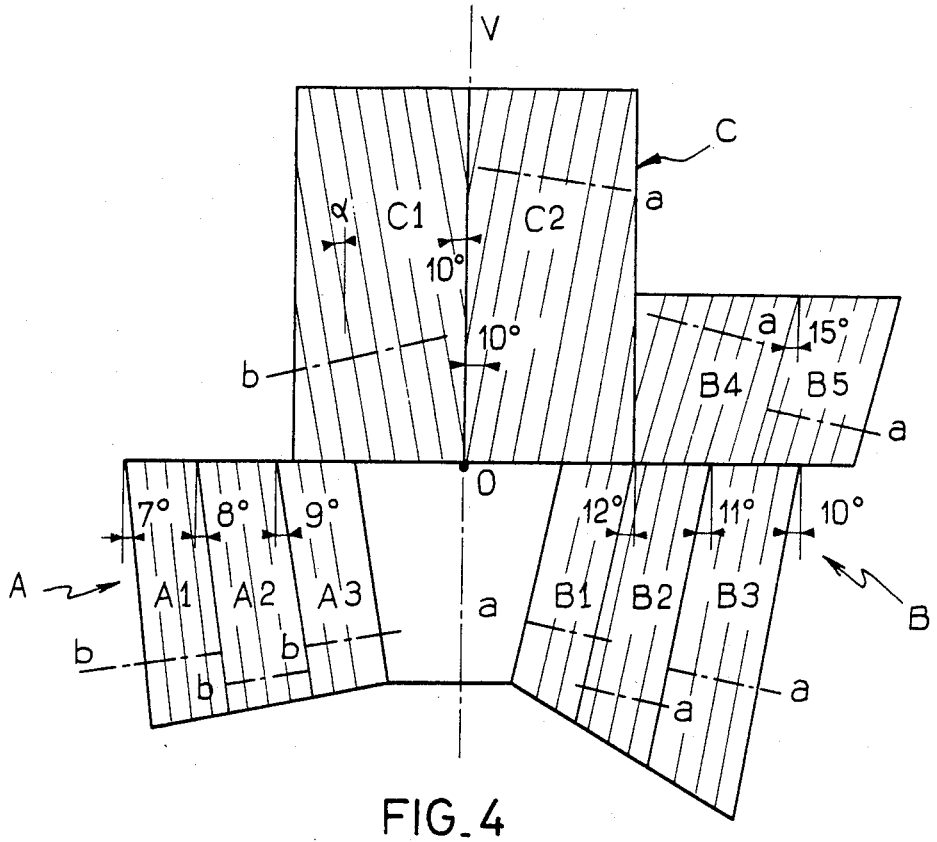
FIG. 4, is a view from the front showing the layout of prism ribs on this glass.
Figure 5A:
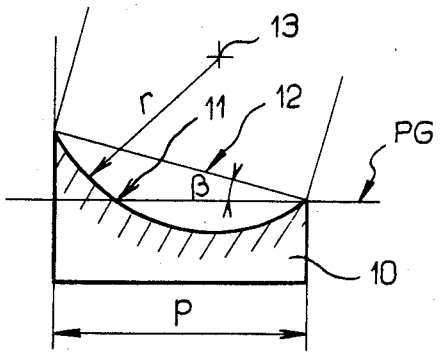
Figure 5B:
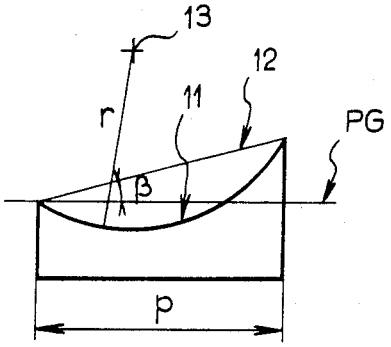
Figure 10:
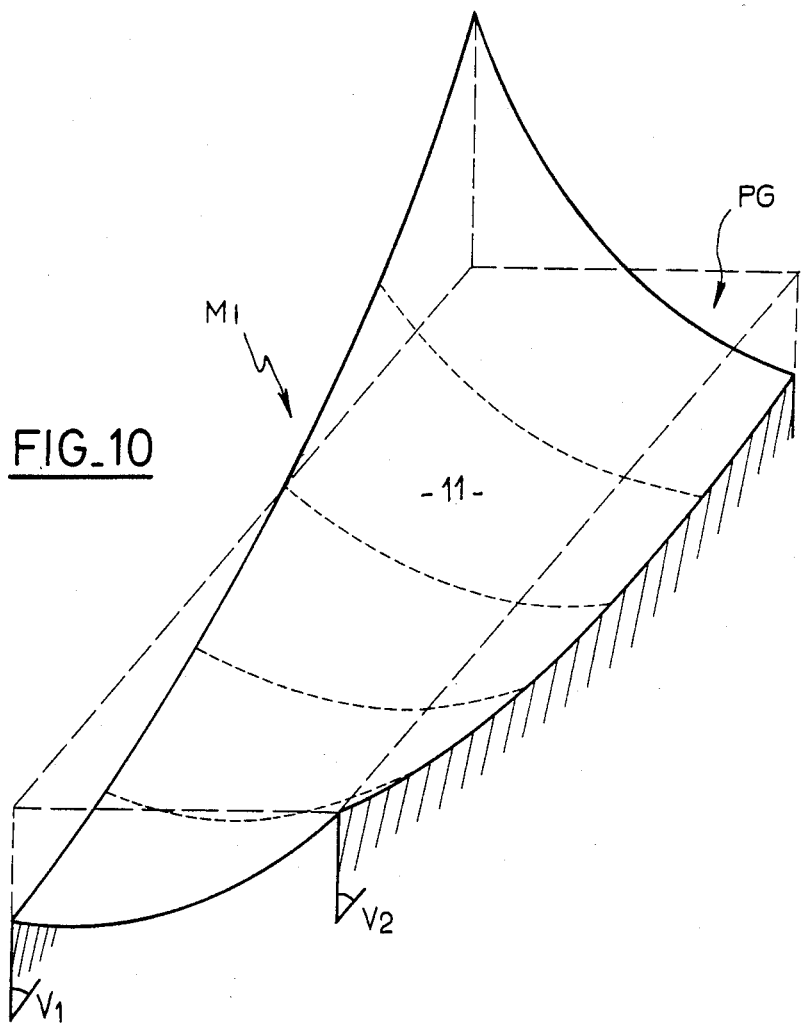
Figure 11:
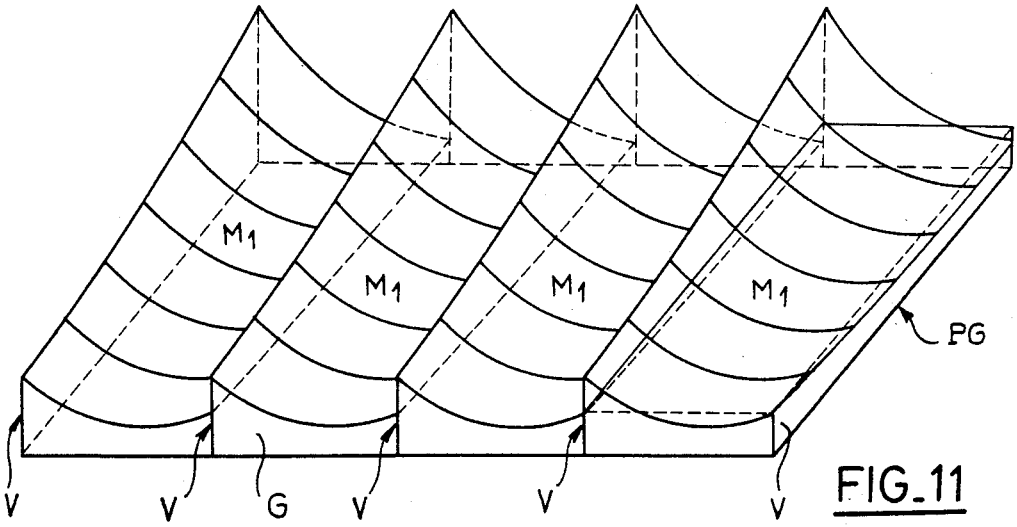
Figure 12:
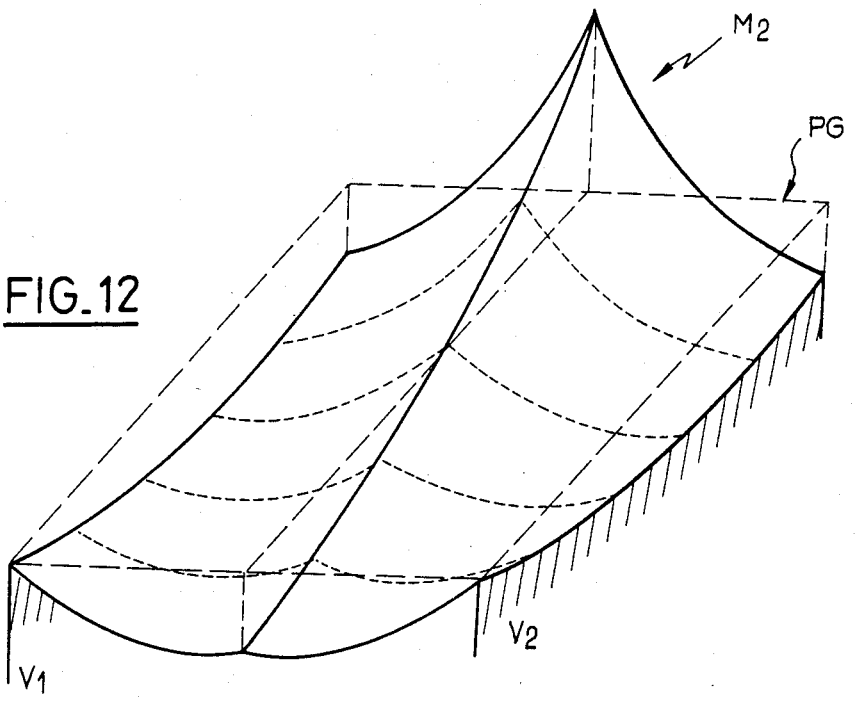
Figure 13:
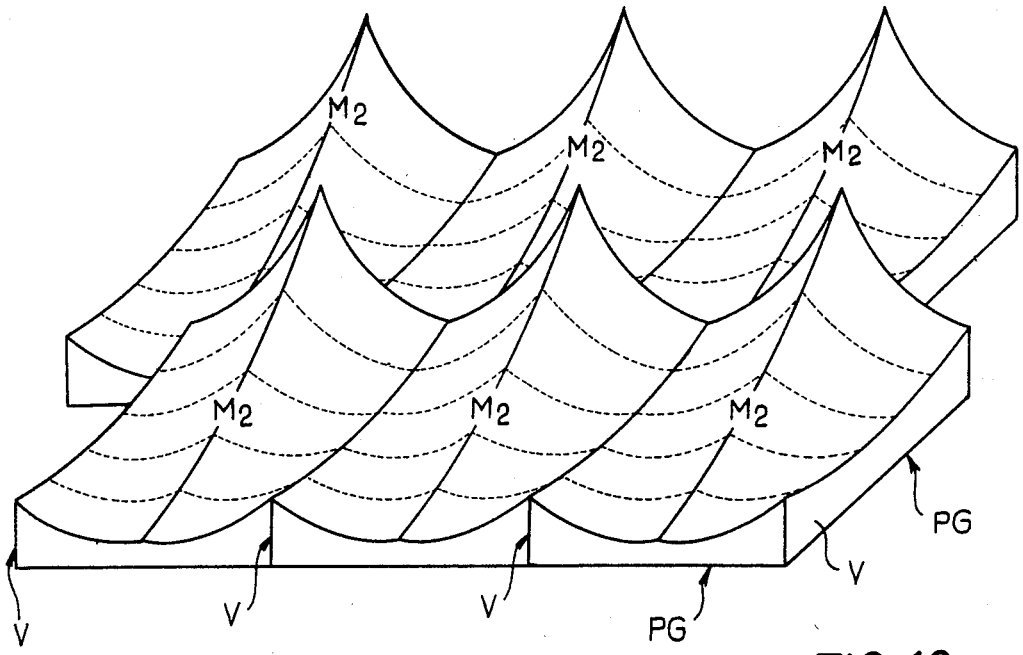

FIGS. 5*a* and 5*b* are diagrammatic sections along the lines a and b shown on the prism ribs of the glass of FIG. 4;

FIGS. 6, 7, 8 and 9 are projections on a screen at 25 meters showing the effect of various features on the glass in the formation of an optimum dipped beam;

FIG. 10 shows in a perspective view of the interior of the glass the structure of one embodiment of a deflecting element;

FIG. 11 is a perspective view of a series of adjacent structures as shown in FIG. 10 separated by vertical separating planes;

FIG. 12 is a perspective view similar to FIG. 10 showing a second embodiment, and FIG. 13 is a perspective view of a series of adjacent structures as shown in FIG. 12.

Figure 1A:
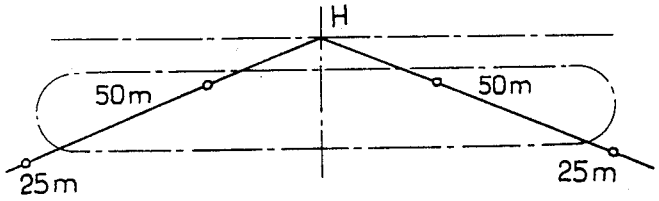
Figure 1:
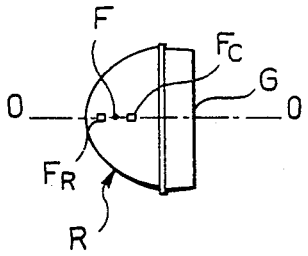
Figure 2A:
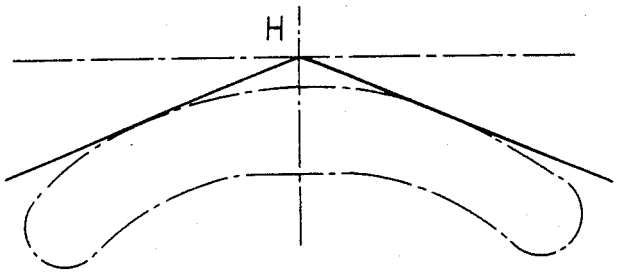
Figure 2:
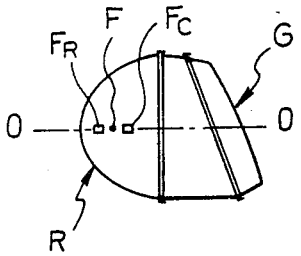
Figure 3:
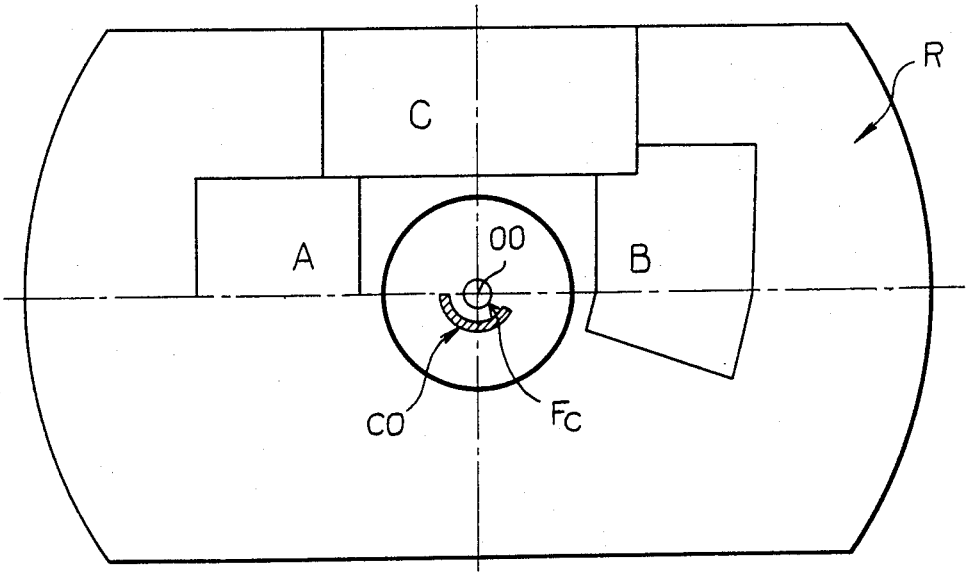
FIG. 3 shows a front view of the reflector or a dipped headlamp which co-operates with an inclined glass having a structure according to the invention.

FIG. 3 shows a reflector R which is parabolic about an axis 0—0, co-operating with a dipped beam filament $F_C$ placed as is usual slightly in front of the focus F of the reflector R (the arrangement is the same as that shown in FIGS. 1 and 2). This reflector co-operates with a very inclined glass G generally as shown in FIG. 2 but whose inclination is about 45° from top to bottom and from back to front.

In order to form a dipped beam (which in the chosen example is a beam for driving on the right, though it will be appreciated that features may be laterally inverted for driving on the left, in a way which will be evident to those skilled in the art), the dipped beam filament $F_C$ co-operates in the usual manner with a screening cap CO which effects a cut-off of the beam by masking certain rays emitted by the dipped beam filament $F_c$. This arrangement is conventional and will not be described in greater detail.

The inclination of the glass disturbs the dipped beam illumination as has been described above. This disturbance is particularly significant for certain critical zones of the glass corresponding to homologous critical zones on the reflector. In this case, a zone of the reflector reflects rays through a zone of the glass which is homologous with it.

Three critical zones A, B, C of the reflector are shown in FIG. 3. The relative positions and dimensions shown in FIG. 3 are exact and form a part of this embodiment of the invention, completing the description thereof.

FIG. 4 shows in the general plane of the glass the homologous critical zones A, B, C of the glass, zone A being subdivided into three sub-zones A1, A2, A3, zone B into five sub-zones B1, B2, B3, B4, B5, and zone C into two sub-zones C1 and C2. The relative dimensions and positions shown in FIG. 4 are also exact and representative of this embodiment of the invention and complete the description thereof.

As can be seen in FIG. 4, each sub-zone consists of a series of adjacent prismatic elements or prism ribs 10 having the same inclination $\alpha$ with respect to the direction of the longitudinal vertical plane V which contains the optical axis 0 and is perpendicular to the glass. In other words, the parallel generating lines of all the prism ribs 10 of one and the same sub-zone extend in the same direction of inclination $\alpha$ with respect to the vertical plane V. The angle $\alpha$ varies from sub-zone to sub-zone.

FIGS. 5*a* and 5*b* show sections along the lines a and b respectively in FIG. 4. They show accurately the geometric shape of the prism ribs 10. As can be seen active face 11 of each prism rib 10 is formed by the intersection of a virtual prism with which the virtual face 12 forms an angle $\beta$ with the direction of the glass PG (parallel to the plane exterior face of the glass G) and a cylindrical rib having a radius r and an axis 13 parallel to the generating lines of the prism, the axis 13 being located in the mid-perpendicular plane of the virtual face 12. The transverse dimension of a prism rib is defined by its pitch p.

Thus each optical element forming a prism rib is completely defined by its inclination $\alpha$, by its angle of prism $\beta$, by its rib radius r and by its pitch p. As will be seen in greater detail below, for a dipped headlamp of conventional type, the angles $\alpha$ and $\beta$ are between. 3° and 20°, the radius r between 2 and 25 mm, and the pitch p a few millimeters. The way in which the parameters of the elements 10 are determined for each sub-zone will now be described. The pitch p can be chosen a priori within a range from for example 2 to 8 mm, this parameter having in itself no particular significance since it defines the width of the inclined bands defining the location of the elements 10 which whilst retaining the same active surfaces 11 can be replaced by vertical bands as will be seen below. As regards the choice of the other parameters $\alpha$, $\beta$, r, the optical results which are to be achieved and which rigorously define the values $\alpha$, $\beta$, r will be explained using the zone A by way of example.

For the purpose of demonstration, reference will be made successively to FIGS. 6, 7, 8 and 9 which show what would appear on the standard screen at 25 meters in the different hypothetical situations described using the reflector of FIG. 3.

Figure 6:
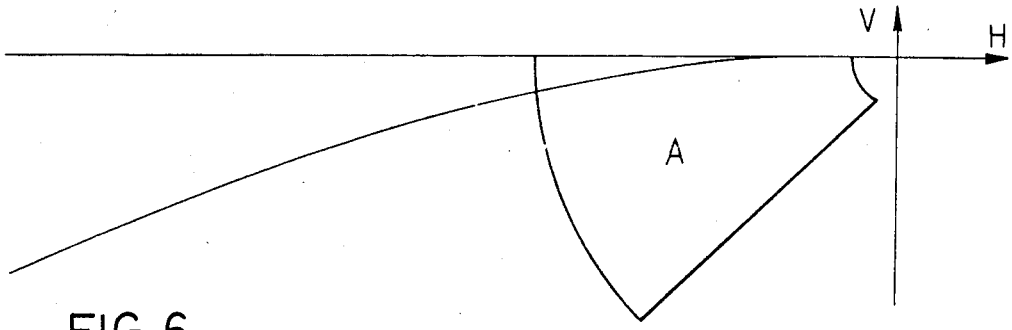

As can be seen in FIG. 6, in the absence of any interposed glass the zone A of the reflector projects on the standard screen a spot of light A below the right-hand cut-off plane H. Such a spot of light is not satisfactory for a dipped beam and it is necessary to interpose a glass having a succession of ribs in its zone A to spread the beam.

Figure 7:
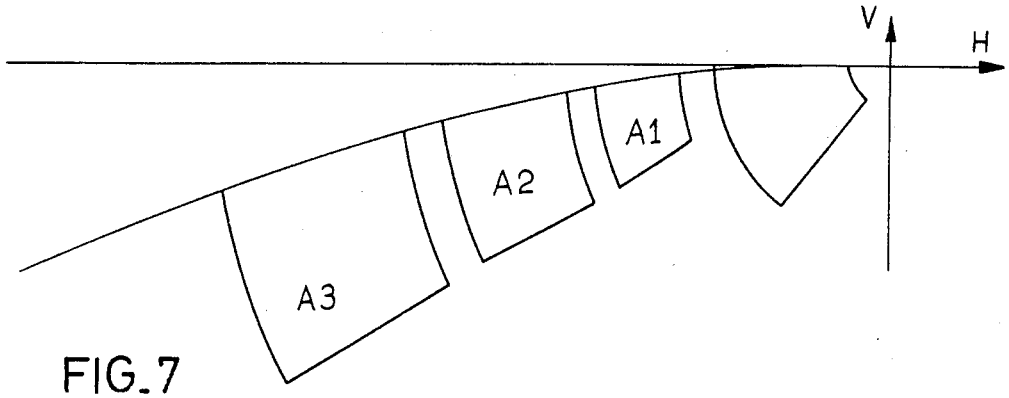

If the glass is subdivided into three sub-zones A1, A2, A3 and if each sub-zone is provided with vertical prismatic elements forming angles $\beta_1$, $\beta_2$, $\beta_3$ with respect to the plane of the glass, this results as shown in FIG. 7 in a distribution comprising three spots of light $A_1$, $A_2$, $A_3$, which certainly in width cover the desired range of spread but which have the double disadvantage of being separated from one another and above all of being very much below the cut-off plane H because of the deflection due to the inclination of the glass.

Figure 8:
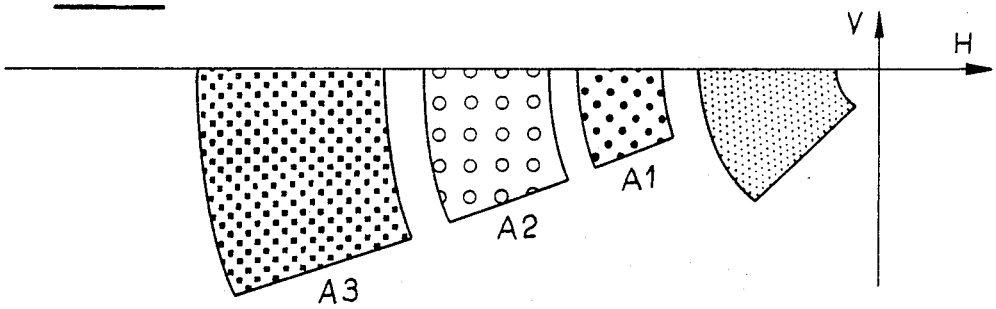

In order to obtain satisfactory illumination it is necessary on the one hand to bring the three spots $A_1$, $A_2$, $A_3$ to the level of the horizontal cut-off H and on the other hand to merge them with each other and render the illumination which they provide more homogenous. In order to bring these spots to the level of the plane of cut-off H it is sufficient to incline the prisms of each zone by a respective value $\alpha_1$, $\alpha_2$, $\alpha_3$, with respect to the vertical plane V. The illumination shown in FIG. 8 is then obtained where the spots are raised to the level of the horizontal plane of cut-off H.

Figure 9:
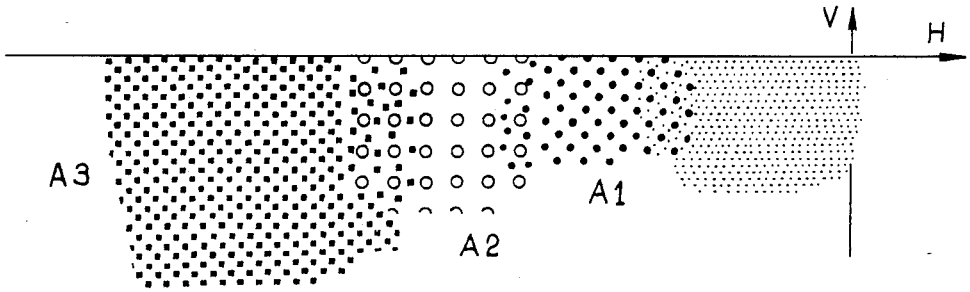

It then remains to merge the three spots with each other for homogenous illumination. This is obtained by providing the prismatic elements with ribs of radius r, as described above, in such a way that the three spots merge with each other as shown in FIG. 9.

It has been shown above how the optimum distribution of FIG. 9 can be obtained by the prism ribs 10 with a judicious choice of the parameters $\alpha$, $\beta$, and r of the prism ribs for each sub-zone $A_1$, $A_2$, $A_3$, of the zone A. In the same way it is possible to determine the prismatic elements 10 in the zone B of the inclined glass, subdivided advantageously into five zones $B_1$ to $B_5$, and in the zones C subdivided into two zones $C_1$ and $C_2$ symmetrical with respect to the central vertical plane V passing through the axis 0.

Overall, with the glass G provided with these prismatic elements 10, the following results are obtained:

- the zone A of the glass preferentially deflects the light to the left of the projected beam in order to form the flat cut-off to the left (in the case of driving on the right);
- zone B of the glass preferentially deflects the light towards the right of the projected beam in order to form the inclined cut-off to the right and to give width to the right of the beam (again in the case of driving on the right);
- zone C serves to widen the beam in the central zone without any preferential direction of deflection. It will be seen below that the two zones $C_1$ and $C_2$ having prism ribs 10 of opposing inclination and orientation can be replaced by a single zone having double prism ribs in which each half has a different orientation and direction from the other hald with which it is essentially symmetrical with respect to the central vertical direction V.

For a rectangular dipped headlamp having aperture dimensions of 190×115 mm, a focal distance of 26.5 mm and a glass inclined by 45°, values are given in Table 1 below for the three critical parameters for the three zones A, B, C of the glass, subdivided and arranged as shown in FIG. 4, the relative dimensions and arrangements of which are to be regarded as exact for this preferred embodiment.

TABLE 1

| Zone | Inclination $\alpha$ (degrees) | Angle $\beta$ (degrees) | Radius r (mm) |
|---|---|---|---|
| A1 | 7 | 4 | 10 to 20 |
| A2 | 8 | 9 | 7 to 10 |
| A3 | 9 | 11 | 4 to 5.5 |
| B1 | 12 | 11 | 4 to 5 |
| B2 | 11 | 9 | 7 to 10 |
| B3 | 10 | 4 | 10 to 20 |
| B4 | 15 | 11 | 5 to 10 |
| B5 | 15 | 9 | 7 to 10 |
| C1 | 10 | 15 | 2.7 |
| C2 | 10 | 15 | 2.7 |

In all the foregoing the space occupied by the prism ribs 10 has been defined as that of inclined bands having the inclination $\alpha$.

As the inclination $\alpha$ varies from one sub-zone to another, the regions of intersection of the different sub-zones can present clearance problems for the production of the glass by moulding. In practice, deflecting elements can be retained on the glass which have as an active surface the surfaces 11 as described above, but they can be distributed as vertical bands separated by vertical planes.

FIG. 10 shows such a prism rib structure $M_1$ seen from the interior of the glass, limited by two vertical planes $V_1$ and $V_2$. The active surface 11 of such an element corresponds to that which has been described above, the parameters $\alpha$, $\beta$ and r being those of the inclined prism rib described above which passes through the same region in the centre of the glass. The active surface 11 is part-cylindrical and corresponds to a prism as defined above. In order to help in understanding the shape, broken lines following the plane of the glass PG and the direction which is perpendicular to it have been included.

For a complete glass G using the structure $M_1$ shown in FIG. 10, the juxtaposition of structures shown in FIG. 11 is obtained, the different structures being separated by vertical planes V, thus eliminating any problem of lateral zone connection.

Finally, FIG. 12 shows, viewed from the interior of the glass, a double deflecting element $M_2$ connecting the active surfaces 11*a* and 11*b* of two elements respectively of zones $C_1$ and $C_2$ into one double element limited by vertical planes $V_1$ and $V_2$. As above, the plane of the glass PG and its perpendiculars are shown in broken lines. The implementation of the structures $M_2$ of the type shown in FIG. 12 distrubuted in two staggered rows on a complete glass is shown in FIG. 13.

In all the Figures the same reference numerals designate identical or homologous elements. The shapes of the structures $M_1$ and $M_2$ as shown in FIGS. 10 to 13 form part of the preferred embodiment of the invention.

Finally, although the invention has been described in relation to the production of an inclined glass for a dipped headlamp, it must be understood that this example is not limiting and that the invention is applicable to any critical zone of the inclined glass when it is necessary to eliminate the damaging effect of the deflection of the light rays caused by the inclination of the glass.

I claim:

1. A headlamp of an automobile, comprising at least one light source, at least one reflector co-operating with the light source in order to reflect a beam of light rays substantially parallel to an optical axis and an imaginary central vertical plane containing said axis, an inclined front glass located in the path of said light rays, the glass being formed, in certain critical zones, with prism elements arranged to disperse laterally the light rays, said prism elements being inclined by an angle $\alpha$ with respect to said central vertical plane, whereby the vertical deflection effect caused by the inclination of the glass is compensated, the active surface of each prism element being defined by the intersection of a prism surface having an angle $\beta$ at its apex and a part-cylindrical rib whose axis is parallel to the inclination $\alpha$ of said prism element, whereby the vertically compensated light rays are merged together.

2. A headlamp as claimed in claim 1 in which the optical elements are located on the internal face of the glass.

3. A headlamp as claimed in claim 1 in which each critical zone of the glass is subdivided into various sub-zones in which the inclination of the optical elements to the vertical remains the same.

4. A headlamp as claimed in claim 1 in which the active surfaces of the optical elements are limited laterally by vertical planes, thereby permitting contiguity of the zones with one another.

5. A headlamp as claimed in claim 1 in which the critical zones of the glass are those which correspond to a great horizontal deflection.

6. A headlamp as claimed in claim 5 in which one of the critical zones of the glass is subdivided into three sub-zones.

7. A headlamp as claimed in claim 5 in which one of the critical zones of the glass is subdivided into five sub-zones.

8. A headlamp as claimed in claim 1 in which the light source is located slightly in front of the reflector, the light source being suitably masked to produce a dipped beam, and in which the critical zones of the glass correspond to parts of the dipped beam below its cut-off limit.

9. A headlamp as claimed in claim 8 in which one critical zone of the glass is constituted by the upper central region of the glass.

10. A headlamp as claimed in claim 9 in which zone constituted by the upper central region of the glass is divided into two sub-zones.

11. A headlamp as claimed in claim 9 in which the active surfaces of the optical elements of the zone constituted by the upper central region of the glass is a double active surface formed by the two intersections of two prisms of opposite orientation with homologous cylindrical ribs.

* * * * *